US005865170A

United States Patent [19]

Moles

[11] Patent Number: 5,865,170

[45] Date of Patent: Feb. 2, 1999

[54] CUSTOMIZABLE MOUTHPIECE FOR SCUBA-DIVERS

[76] Inventor: Randall C. Moles, 107—12th St., Racine, Wis. 53403

[21] Appl. No.: 899,466

[22] Filed: Jul. 23, 1997

[51] Int. Cl.[6] ..... A62B 18/08

[52] U.S. Cl. ..... 128/201.26; 128/201.25; 128/206.29

[58] Field of Search ..... 128/201.26, 201.27, 128/205.22, 205.25, 206.29

[56] References Cited

U.S. PATENT DOCUMENTS

| | | | |
|---|---|---|---|
| D. 246,671 | 12/1977 | Ceraiway . | |
| 1,302,004 | 4/1919 | Brown . | |
| 1,466,559 | 8/1923 | Purdy . | |
| 2,678,043 | 5/1954 | Stark . | |
| 3,107,667 | 10/1963 | Moore . | |
| 3,250,272 | 5/1966 | Greenberg . | |
| 3,411,501 | 11/1968 | Greenberg . | |
| 3,844,281 | 10/1974 | Shamlian . | |
| 3,929,548 | 12/1975 | Shamlian . | |
| 3,993,060 | 11/1976 | Mitchell . | |
| 4,031,888 | 6/1977 | Walters . | |
| 4,066,077 | 1/1978 | Shamlian . | |
| 4,126,689 | 1/1979 | Shamlian . | |
| 4,230,106 | 10/1980 | Gesslin et al. . | |
| 4,466,434 | 8/1984 | Brownstein . | |
| 4,516,938 | 5/1985 | Hall . | |
| 4,608,021 | 8/1986 | Barrett . | |
| 4,610,246 | 9/1986 | Delphia . | |
| 4,631,030 | 12/1986 | von Weissenfluh . | |
| 4,664,109 | 5/1987 | Rasocha . | |
| 4,673,353 | 6/1987 | Nevin . | |
| 4,675,324 | 6/1987 | Lake, Jr. . | |
| 4,818,231 | 4/1989 | Steiner et al. . | |
| 4,836,782 | 6/1989 | Gonser . | |
| 4,848,365 | 7/1989 | Guarlotti et al. . | |
| 4,860,739 | 8/1989 | Vandepol . | |
| 4,862,903 | 9/1989 | Campbell | 128/861 |
| 4,928,710 | 5/1990 | Campbell | 128/861 |
| 5,031,611 | 7/1991 | Moles . | |
| 5,048,519 | 9/1991 | Kasama et al. | 128/207.14 |
| 5,282,462 | 2/1994 | Kudo | 128/204.26 |
| 5,305,741 | 4/1994 | Moles . | |
| 5,386,825 | 2/1995 | Bates | 128/205.27 |

*Primary Examiner*—Mickey Yu
*Assistant Examiner*—Dinh X. Nguyen
*Attorney, Agent, or Firm*—Jansson, Shupe, Bridge & Munger, Ltd.

[57] ABSTRACT

An improvement to a customizable scuba-diving mouthpiece having a passageway-forming front member extending from a proximal in-mouth end to a distal outside end, and a U-shaped thermoformable back member having a forward middle portion, flanges and bite portions configured to provide moldability at substantially all points of contact between mouthpiece and teeth. The improvement includes the forming of a concave inner and outer surface on the leg portion in order to reduce jaw fatigue, the rearward termination of the inner upstanding flange substantially lateral to the diver's first molar and the tapering of the rear portions of the leg members so as to provide a more comfortable fit.

10 Claims, 3 Drawing Sheets

CUSTOMIZABLE MOUTHPIECE FOR SCUBA-DIVERS

FIELD OF THE INVENTION

This invention is related generally to scuba-diving mouthpieces and, more particularly, to mouthpieces of the type customizable for individual divers.

BACKGROUND OF THE INVENTION

Scuba-diving mouthpieces of various kinds have been known and used for many years. The great majority of such mouthpieces are not customizable for individual divers, but some customizable scuba-diving mouthpieces have been known or used. Examples of customized or customizable scuba-diving mouthpieces are those shown in U.S. Pat. Nos. 3,107,667 (Moore), 3,844,281 (Shamlian), 3,929,548 (Shamlian), 4,136,689 (Shamlian), 5,031,611 (Moles) and 5,305,741 (Moles).

Despite advances in recent years, there are many problems and shortcomings with scuba-diving mouthpieces of the prior art, including those of the above-listed patents. One fairly common problem relates to mouth fatigue experienced by scuba divers including those of the above labeled patents.

The Moles patents identified above brought about significant improvements that helped to overcome many of the problems related to mouth fatigue and the production of a customized fit. Despite such significant improvements, problems still remain particularly in regard to the lack of a tight seal between the mouthpiece and the diver's gums and the gag reflex that results when an object is inserted in the rear portions of the mouth.

Regarding the formation of a tight seal, mouthpieces of the prior art are unable to form as strong a seal between the diver's gums and the mouthpiece itself as may be desired. Known mouthpieces are shaped such that the top and bottom of their front portion are substantially aligned with the diver's gum line. Such alignment prevents the formation of a strong seal between the diver's gums and the mouthpiece thereby allowing for water to seep into the diver's mouth. A mouthpiece that would more comfortably allow for the formation of a seal between itself and the diver's gums would be an improvement in the art.

Another major problem associated with scuba-diving mouthpieces is the gag-reflex that is activated by the extension of the bite portion further back into the diver's mouth. While moving the contact location between the diver's teeth and the mouthpiece further back in the mouth decreases jaw fatigue, such extension increases the likelihood that the diver will "gag" on rear portions of the mouthpiece. There is a need for improvements which will serve to decreasing jaw fatigue while reducing the propensity for gag-reflexes.

Finally, the outer surfaces of known scuba-diving mouthpieces are such that the diver's lips and cheeks are forced to stretch in order to completely surround the device. An improvement in the shape of the outer surface such that it would allow the diver's mouth to close more naturally around the mouthpiece would be an important improvement in the art.

Mouthpieces are typically held in place by means of the diver's bite on retaining members which project inwardly from a lip-engaging portion to positions between the upper and lower teeth. This not only places significant pressures on small portions of the diver's teeth, that is, the portions engaging the retaining members, but the constant muscle pressure needed for secure retention of such mouthpieces can cause significant muscle strain and aching.

The problems of jaw fatigue and joint strain during long use are accompanied by a related problem—a tendency toward an inability by the diver to easily maintain the mouthpiece in the proper orientation, particularly when pressures are applied to the mouthpiece from outside the diver's mouth. Unwanted pressures on the mouthpiece grip come from water currents (relative to the diver), contacts made with diving apparatus, and a variety of other causes. It is essential, of course, that the diver's mouthpiece, which is the sole source of air, remain in place. Thus, the concern about pressure interfering with the grip of the diver on his or her mouthpiece is more than a casual concern.

Some problems with current scuba-diver mouthpieces can be understood better by reference to the mouth, the jaw, and the teeth of a typical person. The jawbone is a lengthy angled member which pivots with respect to the skull and about the jaw joint well back from the mouth. Such joint is typically positioned considerably above the level of the teeth and well behind the position of the teeth. From such joint, the jaw has a generally downwardly and slightly forwardly extending portion which extends generally to a position rearwardly spaced from the teeth, and a more forwardly, but still downwardly, extending portion which carries the teeth of the lower jaw and extends forwardly beneath the upper jaw. The angle between the two positions of the lower jaw is referred to herein as the "jaw angle."

Opening and closing muscle tissue masses are secured to the jaw at positions forward of the jaw joint, but well rearward of the teeth. The muscles secured to the lower jaw create a lever arm which extends from the jaw joint all the way to the point of contact pressure of the lower jaw with the upper jaw or with whatever is being bitten.

When using a typical diving mouthpiece, or a customized diving mouthpiece such as those shown in the aforementioned Shamlian patents, the lever arm of the lower jaw extends from the jaw joint all the way forward to the position of the eye teeth where the mouthpieces are gripped between the diver's teeth.

Two separate problems are created when the mouthpiece contact occurs in this manner at such forward position in the mouth: First, since the distance from the center of muscle effort is long, a significant increase in muscle force is necessary to stabilize and retain the mouthpiece. This is what causes the muscles to quickly fatigue and often to become painful, which leads to jaw aches and headaches. A second and related problem of such long lever arm is created when standard mouthpieces, or customized mouthpieces of the Shamlian type are used, in that there is a severe increase in pressure within the jaw joint, well back in the head.

If the contact location is extended to the back of the mouth, the lever arm is shortened and advantages are achieved, including a reduction in the muscle force necessary to hold the mouthpiece and a reduction in the corresponding jaw pressure. Lengthening the mouthpiece retention piece to allow contact at a more rearward position in the mouth creates a shorter, and thus more favorable, lever arm. This resists torque from movement of the diver's regulator. That is, a better grip can be maintained with less exertion.

However, extension of the posterior bite pieces has been difficult or unworkable in the prior art due to variability in the jaw alignment of different people. Only a completely customized bite portion would allow for this. The variability in the angle between the teeth of the upper and lower jaws is a major problem. Such variability is caused by variations in the aforementioned lower jaw angle and also by the angle of the upper jaw with respect to the lower jaw. The upper jaw may be tipped up or down in the front or back.

Furthermore, the extension of the bite pieces result in an increase of the gag-reflex. Therefore, in order to take advantage of the reduction in jaw fatigue that results from a reduction in the length of the lever arm, alterations must be made to the bite portions in order to reduce the possibility of gagging.

While there have been a number of efforts to make improved customizable scuba-diving mouthpieces, there has remained a clear need for significant improvements in the field of customizable scuba-diving mouthpieces.

OBJECTS OF THE INVENTION

An object of the invention is to provide an improved customizable scuba-diving mouthpiece that overcome some of the problems and shortcomings of the prior art.

Another object of the invention is to provide an improved customizable scuba-diving mouthpiece that provides a stronger seal between the diver's gums and the mouthpiece.

Still another object of the invention is to provide an improved customizable scuba-diving mouthpiece that is less likely to cause a diver to "gag."

Yet another object of the invention is to provide an improved customizable scuba-diving mouthpiece that results in less jaw fatigue to the user.

Still another object of the invention is to provide an improved customizable scuba-diving mouthpiece that reduces perioral muscular strain. How these and other objects are accomplished will become apparent from the following descriptions and from the drawings.

SUMMARY OF THE INVENTION

The invention involves an improvement to a customizable scuba-diving mouthpiece designed to grip a diver's teeth. The mouthpiece involved in the invention is comprised of: (1) a front member that extends from a proximal in-mouth end to a distal outside end thereby forming a horizontal passageway from the distal end to the proximal end; and (2) a U-shaped thermoformable back member.

The back member includes a pair of leg portions and a forward middle portion that is secured to the front member's proximal end and positioned for thermoformable custom moldable engagement with the diver's forward teeth. The leg portions extend from the middle portion rearwardly to pass between the diver's molars and terminate at the rear of the mouth. Each leg portion has inner and outer upstanding flanges and a substantially horizontal bite portion extending between them.

The bite portion has thermoformable custom-moldable upper and lower surfaces. The flanges have upwardly-extending and downwardly-extending flange portions with upper and lower edges, respectively. Inside surfaces are spaced between the flanges for thermoformable custom-moldable engagement with opposite side surfaces of the user's teeth. The outer flanges extend forward to merge with the forward middle portion.

The improvement to the mouthpiece involves terminating the inner upstanding flange of each leg portion substantially lateral to the diver's first molar, and having the outer flange of each leg portion form a concave outside surface on the leg portion such that the concave surface has a nadir line substantially along and adjacent to the horizontal bite portion.

In another embodiment of the invention, the inner upstanding flange of each leg portion forms a second concave outside surface that also has a nadir line substantially along and adjacent to the horizontal bite portion. In still another embodiment, the outer upstanding flange of each leg portion terminates forward of the diver's second molar.

In a preferred embodiment of the invention, the bite portion of the mouthpiece has, at positions adjacent to the inner flange, a first width, and at positions beginning immediately rearward of the inner flange, a second width which is no greater than the first width. In yet another preferred embodiment, the bite portion, at positions rearward of the inner flange, narrows progressively at positions farther from the inner flange. In a specific version of this embodiment, the bite portion has a plurality of substantially parallel grooves beginning rearward of the outer flange and oriented transverse to the bite portion.

In a highly preferred embodiment of the invention, an upstanding lip flange is attached to the forward middle portion of the U-shaped back member adjacent to the proximal in-mouth end of the front member. The flange is attached in such a way that it forms a concave outside surface. In a more specific embodiment of the invention, the upstanding lip flange has an upper edge that has a center notch positioned to accommodate the diver's frenum.

In another highly preferred embodiment of the invention, the forward end of the inner upstanding flange of each leg portion originates lateral to the diver's cuspid. In this embodiment, the bite portion of the mouthpiece has, at positions adjacent to the inner flange, a first width. Such bite portion also has at positions immediately adjacent to the forward end of the inner upstanding flange a second width which is narrower than the first width. Finally, the bite portion has, at positions beginning immediately rearward of the inner flange, a third width which is no greater than the first width.

In still another preferred embodiment of the invention, the front member of the mouthpiece has a first and second concave surface opposite of each other and adjacent to the forward middle portion of the U-shaped back member. In this embodiment, the concave surfaces have a nadir line substantially perpendicular to the long axis of the horizontal passageway.

In yet another version of the preferred embodiment, the mouthpiece is made of a thermoformable material. The horizontal passageway of the front member has an inner and outer surface and a groove encircling the passageway is cut into the inner surface approximately half-way between the proximal in-mouth end and the distal end. The groove is cut at a depth such that the material between the groove and the outer surface of the horizontal passageway is at least 1.5 millimeters thick.

DETAILED DESCRIPTIONS OF PREFERRED EMBODIMENTS

Figure 1:
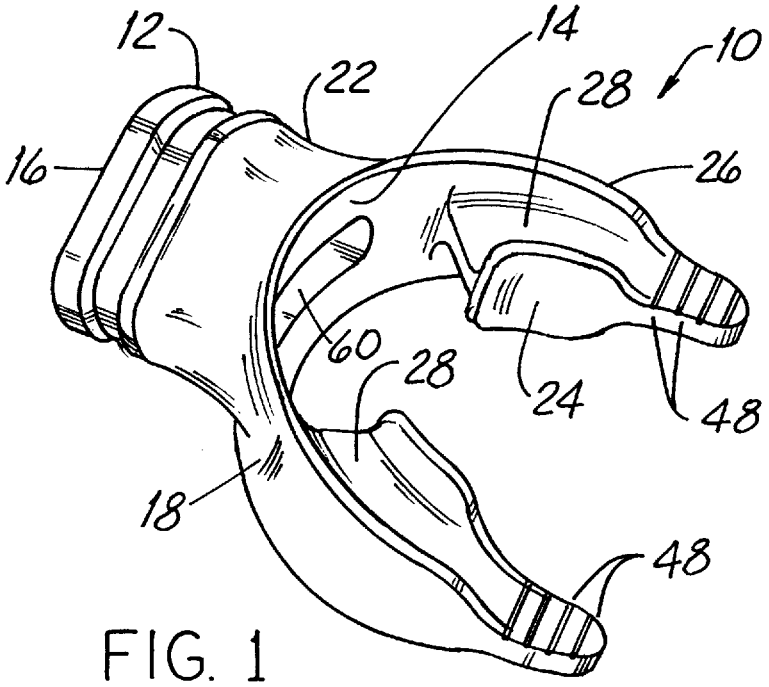
FIG. 1 is a perspective view of a particular embodiment of a customizable scuba-diving mouthpiece.
Figure 3:
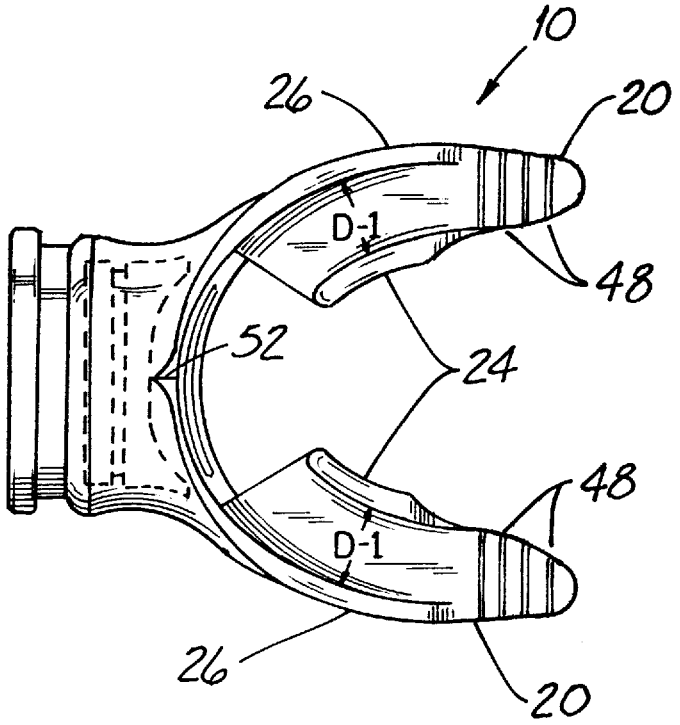
FIG. 3 is a top view of a particular embodiment of a customizable scuba-diving mouthpiece that includes a notch in the upper lip flange.
Figure 5:
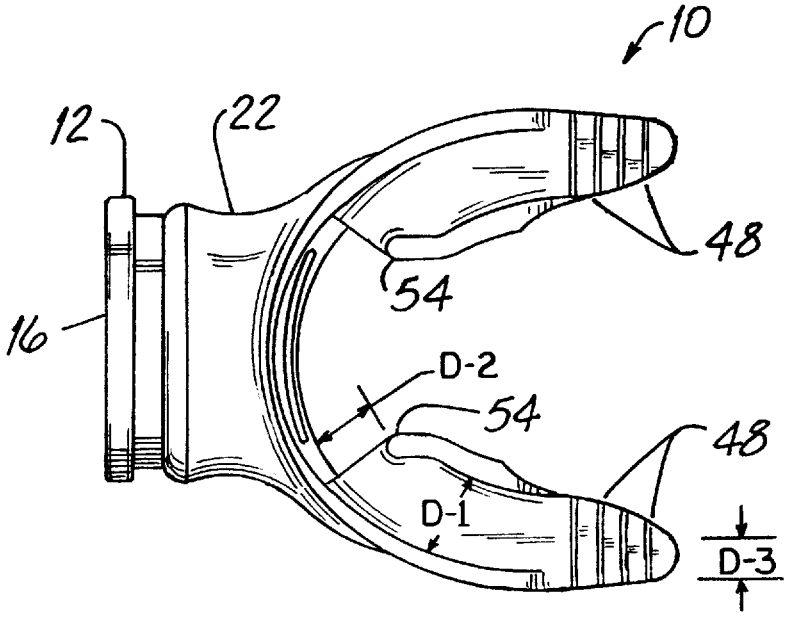
FIG. 5 is a top view of a particular embodiment of a customizable scuba-diving mouthpiece wherein the bite portion immediately adjacent to the front portion of the inner flange is narrower than the bite portion at positions adjacent to the inner flange.

FIGS. 1, 3 and 5 show the invention which involves an improvement to a customizable scuba-diving mouthpiece 10 designed to grip a diver's teeth. The mouthpiece 10 involved in the invention is comprised of: (1) a front member 12 that extends from a proximal in-mouth end 14 to a distal outside end 16 thereby forming a horizontal passageway 60 from the distal end 16 to the proximal end 14; and (2) a U-shaped thermoformable back member 18.

The back member 18 includes a pair of leg portions 20 and a forward middle portion 22 that is secured to the front member's proximal end 14 and positioned for thermoformable custom moldable engagement with the diver's forward teeth. The leg portions 20 extend from the middle portion 22 rearwardly to pass between the diver's molars and terminate at the rear of the mouth. Each leg portion 20 has inner and outer upstanding flanges 24, 26 and a substantially horizontal bite portion 28 extending between them.

The bite portion 28 has thermoformable custom-moldable upper and lower surfaces 30, 32. These surfaces can be customized to fit the imprint of the diver's teeth thereby resulting in a more comfortable fit. The flanges 20, 26 have upwardly-extending and downwardly-extending flange portions 34, 36 with upper and lower edges 38, 40, respectively. The outer flanges 26 extend forward to merge with the forward middle portion 22. Inside surfaces 42 are spaced between the flanges 24, 26 for thermoformable custom-moldable engagement with opposite side surfaces of the user's teeth. Such inner surfaces 42 join the vertical flanges 24, 26 along a curved radius thereby allowing the mouthpiece 10 to better grip the diver's teeth thus reducing the effort required to hold the mouthpiece 10 in the mouth.

Figure 2:
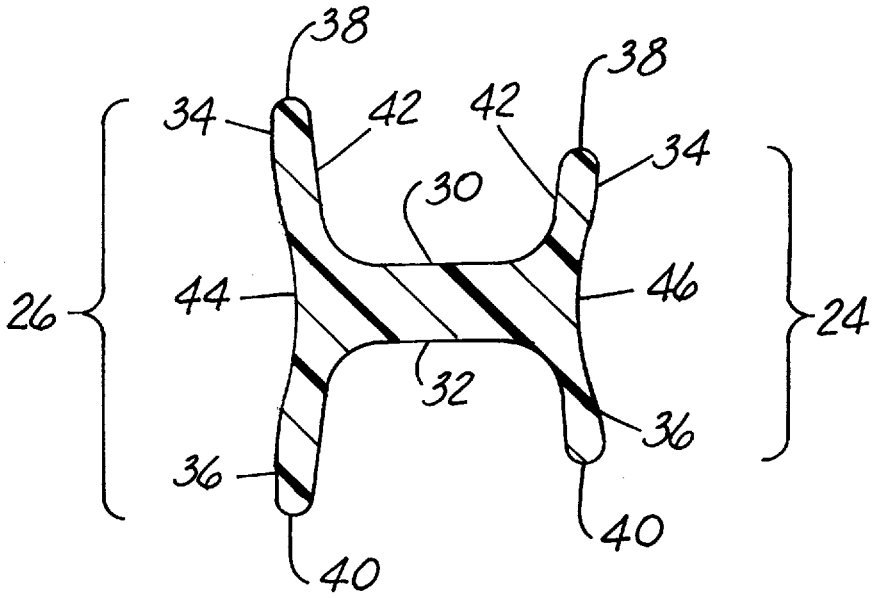
FIG. 2 is an enlarged section, without background, taken along section 2—2 as indicated in FIG. 1.

The improvement to the mouthpiece 10, as shown in FIGS. 1 and 2, involves terminating the inner upstanding flange 24 of each leg portion 20 substantially lateral to the diver's first molar, and having the outer flange 26 of each leg portion 20 form a concave outside surface 44 on the leg portion 20 such that the concave surface 44 has a nadir line substantially along and adjacent to the horizontal bite portion 28.

The lateral surfaces of the tongue activate the gag-reflex. By terminating the inner upstanding flange 24 substantially lateral to the diver's first molar the gag-reflex is reduced because there is less flange surface acting on the lateral surface of the tongue.

The outer flange 26 of each leg portion 12 helps to form a seal between the diver's gums and the mouthpiece thus preventing water from seeping into the diver's mouth. Current mouthpieces have flat or convex outer surface. This causes the muscles in the diver's face to have to stretch to cover the mouthpiece. A concave outer surface reduces the burden on the face muscles resulting in less jaw-fatigue and greater comfort to the diver.

FIG. 2 shows another embodiment of the invention in which the inner upstanding flange 24 of each leg portion 20 forms a second concave outside surface 46 that also has a nadir line substantially along and adjacent to the horizontal bite portion 12. As with the reduction of the inner flange 24 substantially lateral to the diver's first molar, the forming of a concave outside surface 46 on the inner flange 24 reduces the diver's gag-reflex. This is because there is less of the inner flange's 24 outer surface 46 reacting against the lateral surface of the diver's tongue. Additionally, the concave surfaces 44, 46 allow the mouthpiece to compensate for the lateral expansion of the bite surface 28 that takes place when the mouthpiece is molded to the diver's teeth.

In still another embodiment, the outer upstanding flange 26 of each leg portion 20 terminates forward of the diver's second molar thus stiffening the posterior member of the mouthpiece 10 thereby distributing the forces acting on the diver's mouth and reducing impingement on the jaw in the rear area of the mouth. This results in less jaw fatigue and greater comfort for the diver.

FIG. 3 shows another preferred embodiment of the invention where the bite portion 28 of the mouthpiece 10 has, at positions adjacent to the inner flange 24, a first width D-1, and at positions beginning immediately rearward of the inner flange 24, a second width which is no greater than the first width D-1. This narrowing of the inner flange 24 brings about a reduction in the gag-reflex as it allows for greater spacing between the flange 24 and the diver's tongue. In yet another preferred embodiment, the bite portion 28, at positions rearward of the inner flange 24, narrows progressively at positions farther from the inner flange 24 thereby resulting in an even greater reduction in the gag-reflex. In a specific version of this embodiment, as shown in FIGS. 1, 3 and 5, the bite portion 28 has a plurality of substantially parallel grooves 48 beginning rearward of the outer flange 26 and oriented transverse to the bite portion 28. Such grooves 48 allow the diver to shorten the mouthpiece by symmetrically cutting-off the bite portion 28 that extends beyond the outer flange 26. This results in greater comfort for the diver.

Figure 4:
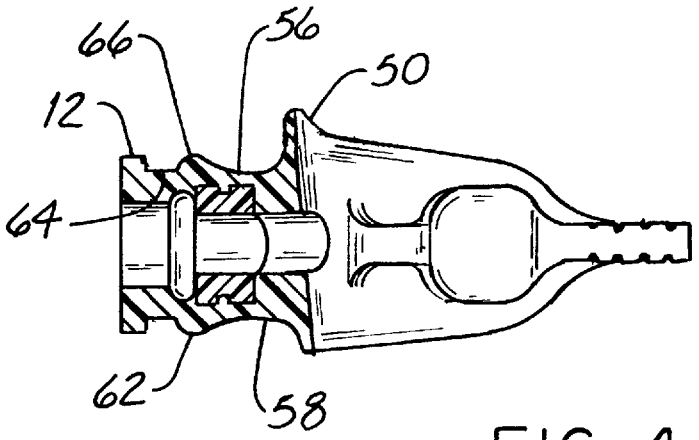
FIG. 4 is a sectional view taken along section 4—4 as indicated in FIG. 1.

In a highly preferred embodiment of the invention, as shown in FIG. 4, an upstanding lip flange 50 is attached to the forward middle portion 22 of the U-shaped back member 18 adjacent to the proximal in-mouth end 14 of the front member 12. The flange 50 is attached in such a way that it forms a concave outside surface. Such lip flange 50 forms a seal between the gum line and the mouthpiece 10 at the front of the diver's mouth. This seal allows for a snug fit in the diver's mouth thereby reducing the amount of effort required to hold the mouthpiece 10 in position. This in turn results in less jaw fatigue to the diver.

FIG. 3 shows a more specific embodiment of the invention where the upstanding lip flange 50 has an upper edge that has a center notch 52 positioned to accommodate the diver's frenum.

In another highly preferred embodiment of the invention shown in FIG. 5, the forward end 54 of the inner upstanding flange 24 of each leg portion 12 originates lateral to the diver's cuspid. In this embodiment, the bite portion 28 of the mouthpiece 10 has, at positions adjacent to the inner flange 24, a first width D-1. Such bite portion also has at a position immediately adjacent to the forward end of the inner upstanding flange a second width D-2 which is narrower than the first width D-1. This narrowing results in a more comfortable fit because of the way teeth are arranged. As you move forward in one's mouth, the teeth become more narrow and the dental arrangement begins to curve toward the front of the mouth. By narrowing the bite portion 28 at a position immediately adjacent to the forward end 54 of the inner upstanding flange 24, the mouthpiece 10 conforms more comfortably to the shape of the diver's teeth and actually assists in griping the diver's teeth thereby reducing muscle fatigue. Finally, the bite portion 28 has, at positions beginning immediately rearward of the inner flange 24, a third width D-3 which is no greater than the first width D-1. As mentioned above, this results in a reduction of the diver's gag-reflex.

In still another preferred embodiment of the invention, as shown in FIG. 4, the front member 12 of the mouthpiece 10 has a first and second concave surface 56, 58 opposite of each other and adjacent to the forward middle portion 22 of the U-shaped back member 18. In this embodiment, the concave surfaces 56, 58 have a nadir line substantially perpendicular to the long axis of the horizontal passageway 60. The concave surfaces 56, 58 provide a resting place for the diver's lips as the mouthpiece 10 pass out of the diver's mouth to the regulator. This resting place results in a more natural closure of the mouth thereby reducing fatigue on the diver's facial muscles.

In yet another version of the preferred embodiment, the mouthpiece 10 is made of a thermoformable material. The horizontal passageway 60 of the front member 12 has an inner and outer surface 64, 66 and a groove 62 encircling the passageway 60 is cut into the inner surface 64 approximately half-way between the proximal in-mouth end 14 and the distal end 16. The groove 62 is cut at a depth such that the material between the groove 62 and the outer surface 66 of the horizontal passageway 60 is at least 1.5 millimeters thick. This reinforcement of the thickness of the material between the groove 62 that a portion of the regulator is seated in and the outer surface 66 of the mouthpiece reduces the possibility of the mouthpiece 10 cracking thereby resulting in longer operational use.

While the principles of the invention have been shown and described in connection with but a few embodiments, it is to be understood clearly that such embodiments are by way of example and are not limiting.

What is claimed is:

1. In a customizable scuba-diving mouthpiece for gripping a diver's teeth having: (1) a front member extending from a proximal in-mouth end to a distal outside end and forming a horizontal passageway from the distal end to the proximal end; and (2) a U-shaped thermoformable back member having (a) a forward middle portion secured to the front member proximal end in position for thermoformable custom moldable engagement with the diver's forward teeth and (b) a pair of leg portions extending from the middle portion rearwardly to pass between the diver's molars and terminate at the rear of the mouth, each leg portion having inner and outer upstanding flanges and a substantially horizontal bite portion extending therebetween, the bite portion having thermoformable custom-moldable upper and lower surfaces and the flanges having upwardly-extending and downwardly-extending flange portions with upper and lower edges, respectively, and inside surfaces spaced for thermoformable custom-moldable engagement with opposite side surfaces of the user's teeth, said outer flanges extending forward to merge with the forward middle portion, the improvement comprising:

the inner upstanding flange of each leg portion rearwardly terminating substantially lateral to the diver's first molar;

the outer flange of each leg portion forming a concave outside surface on the leg portion, the concave surface having a nadir line substantially along and adjacent to the horizontal bite portion;

the outer flange of each leg portion rearwardly terminating forward of the diver's second molar;

the horizontal bite portion extending beyond the diver's second molar;

the bite portion having, at positions adjacent to the inner flange, a first width; and the bite portion having, at positions beginning immediately rearward of the inner flange, a second width which is no greater than the first width.

2. The customizable scuba-diving mouthpiece of claim 1 wherein the inner upstanding flange of each leg portion forms a second concave outside surface, the second concave surface having a nadir line substantially along and adjacent to the horizontal bite portion.

3. The customizable scuba-diving mouthpiece of claim 1 wherein the bite portion, at positions rearward of the inner flange, narrows progressively at positions farther from the inner flange.

4. The customizable scuba-diving mouthpiece of claim 1 wherein the bite portion has a plurality of substantially parallel grooves rearward of the outer flange, said grooves being transverse to the bite portion.

5. The customizable scuba-diving mouthpiece of claim 1 wherein:

an upstanding lip flange is attached to the forward middle portion of the U-shaped back member adjacent to the proximal in-mouth end of the front member; and the upstanding lip flange forms a concave outside surface.

6. The customizable scuba-diving mouthpiece of claim 5 wherein:

the upstanding lip flange has an upper edge; and the upper edge has a center notch positioned to accommodate the diver's frenum.

7. The customizable scuba-diving mouthpiece of claim 1 wherein the forward end of the inner upstanding flange of each leg portion originates lateral to the diver's cuspid.

8. The customizable scuba-diving mouthpiece of claim 7 wherein:

the bite portion has, at positions adjacent to the inner flange, a first width;

the bite portion has, at positions immediately adjacent to the forward end of the inner upstanding flange a second width which is narrower than the first width; and the bite portion has, at positions beginning immediately rearward of the inner flange, a third width which is no greater than the first width.

9. The customizable scuba-diving mouthpiece of claim 1 wherein:

the horizontal passageway has a long axis running between the outside end to the in-mouth end;

the front member has a first and second concave surface opposite of each other and adjacent to the forward middle portion of the U-shaped back member; and the concave surfaces having a nadir line substantially perpendicular to the long axis of the horizontal passageway.

10. The customizable scuba-diving mouthpiece of claim 1 wherein:

the mouthpiece is made of a thermoformable material;

the horizontal passageway has an inner and outer surface;

the inner surface has a groove approximately half-way between the proximal in-mouth end and the distal end, said groove encircling the horizontal passageway; and the material between the groove and the outer surface of the horizontal passageway is at least 1.5 millimeters thick.

* * * * *